United States Patent [19]

Hawk

[11] 4,167,348

[45] Sep. 11, 1979

[54] PAINT ROLLER SUPPORT TRAY

[75] Inventor: Gary D. Hawk, Iola, Kans.

[73] Assignee: Harding Development Company, Clearwater, Fla.

[21] Appl. No.: 762,775

[22] Filed: Jan. 25, 1977

Related U.S. Application Data

[63] Continuation-in-part of Ser. No. 636,684, Dec. 1, 1975, which is a continuation-in-part of Ser. No. 549,639, Feb. 13, 1975, Pat. No. 3,947,135, which is a continuation-in-part of Ser. No. 380,603, Jul. 19, 1973, Pat. No. 3,870,420.

[51] Int. Cl.[2] ..... B44D 3/12

[52] U.S. Cl. ..... 401/121; 15/257.06

[58] Field of Search ..... 401/121, 123, 131; 15/257.05, 257.06; 248/110, 111, 300, 309

[56] References Cited

U.S. PATENT DOCUMENTS

| | | | |
|---|---|---|---|
| 2,600,197 | 6/1952 | Braun | 15/257.06 |
| 3,087,190 | 4/1963 | Werner | 401/121 |
| 4,025,205 | 5/1977 | Hawk | 401/121 |

*Primary Examiner*—Stephen C. Pellegrino

*Attorney, Agent, or Firm*—Cullen, Sloman, Cantor, Grauer, Scott & Rutherford

[57] ABSTRACT

A paint roller support tray including front and rear ends, a paint well adjacent to and below the rear end for storing a supply of paint, and an inclined surface tapering upwardly from the well to the front end for rolling excess paint off the paint roller. The tray includes a receptacle or socket for receiving a portion of the paint roller frame for thus supporting at least one portion of the paint roller above the well and with the paint roller handle resting on the front end of the tray thereby allowing excess paint from the roller to drip back into the well.

1 Claim, 11 Drawing Figures

PAINT ROLLER SUPPORT TRAY

CROSS-REFERENCE TO RELATED APPLICATIONS

This is a continuation-in-part of my copending application Ser. No. 636,684 filed Dec. 1, 1975, which is a continuation-in-part of my then copending application Ser. No. 549,639, filed Feb. 13, 1975, and now U.S. Pat. No. 3,947,135 of Mar. 30, 1976, which is a continuation-in-part of my then copending application Ser. No. 380,603, filed July 19, 1973, and now U.S. Pat. No. 3,870,420 of Mar. 11, 1975.

BACKGROUND OF THE INVENTION

Conventional paint trays, for use with rollers in applying paint to raw surfaces, are made of cardboard, plastic or metal in roughly rectangular shape. The tray typically has a depression or well near one end into which the painter pours a supply of paint. The well terminates in an inclined surface upon which the painter may roll the paint roller to remove excess paint therefrom.

During periods of non-use of the roller, the painter conventionally places the roller upon the tray with the applying portion resting on the inclined surface. All too often, the paint roller flips out of the tray or rolls into the well causing paint to splash out. In the event that neither of these undesirable results occur, storage of the roller on the inclined surface tends to flaten a portion of the roller surface which is usually manufactured of a wool-like material or flocking or the like.

Thus, it is desirable to provide a paint tray which includes an improved mechanism for holding a point roller during periods of non-use.

In providing these features for a paint tray, several factors must be appreciated. First, the painter normally has several tools and each additional independent tool merely adds to the bulk which the painter must carry from one job location to the next. Thus, an independent paint roller stand is impracticable. Second, paint trays are typically inexpensive and have a short useful life and it is thus extremely important that additional features for paint trays be relatively inexpensive.

Third, any feature added to a paint tray must not interfere with the primary function of the tray, namely, a paint reservoir for use with a paint roller in applying paint to a surface.

Hence, the invention herein relates to an improvement in conventional paint trays, namely, a receptacle for receiving and retaining a portion of the paint roller frame.

SUMMARY OF THE INVENTION

The invention herein relates to providing a simple, inexpensive receptacle as part of a paint tray which serves to support at least a portion of the paint roller above the well of the paint tray during periods of roller non-use. Preferably, the support receptacle holds the roller so that the roller handle rests on the front end of the tray.

BRIEF DESCRIPTION OF THE DRAWINGS

In the drawings, wherein like reference numerals identify corresponding parts.

DETAILED DESCRIPTION OF THE INVENTION

Figure 1:
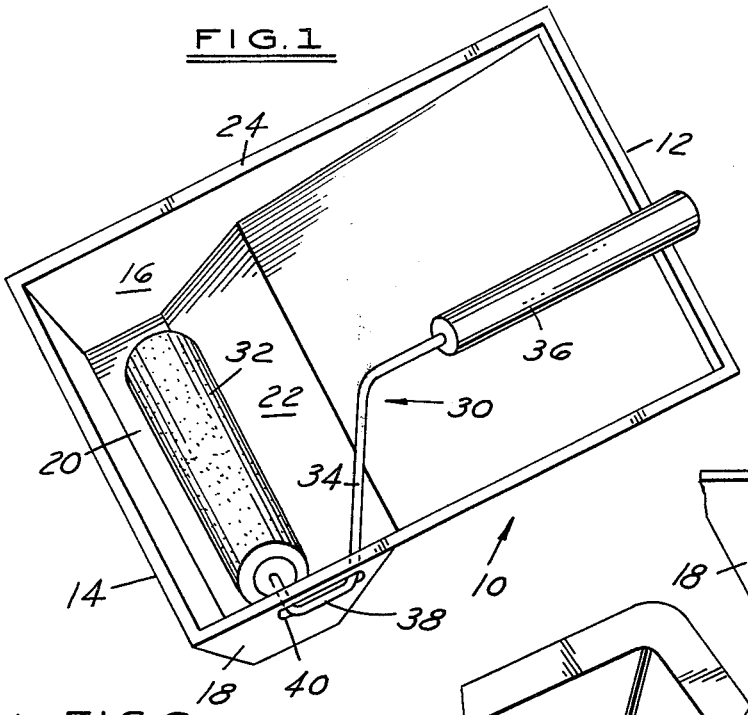
FIG. 1 is a perspective illustration of a paint tray and a paint roller with the paint tray including a receptacle for supporting the roller according the the principles of the present invention.
Figure 4:
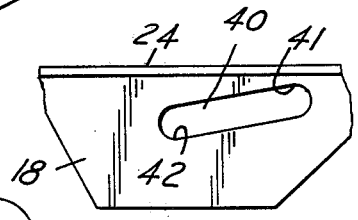
FIG. 4 is an enlarged partial side elevation view of the paint tray of FIGS 1–3.

FIG. 1 illustrates, generally, a conventional type of paint tray 10 having a front end 12 and a rear end 14, opposed side walls 16 and 18, a well or depressed portion 20 positioned adjacent to the rear end 14 and intermediate the side walls for the storage of paint or the like, and an integral inclined surface 22 tapering upwardly from the well 20 to the front end 12. The paint tray also includes, as is conventional, a peripheral edge 24 which may take the configuration of an outwardly extending lateral flange, a curved flange or the like.

FIG. 1 also illustrates, generally, a conventional paint roller 30 having a paint applying portion 32 of a wool-like or flocking material as is conventional, a bent wire frame 34 having the paint applying portion 32 mounted at one end thereof, and a handle 36 mounted on the other end of the frame. Typically, one portion 38 of the frame is of generally C-shaped configuration.

Means are provided for supporting the paint roller on the paint tray above the well 20 so that any paint on the roller drips back into the well thus avoiding wasting of paint. Furthermore, these means provide for the support of the roller above the well to avoid damaging the paint applying portion 32.

Specifically, in a first embodiment of FIGS. 1, 2, 3 and 4, a receptacle such as an elongated slot 40 is formed in the side wall of the tray. In a preferred embodiment, the slot is formed at an angle generally parallel to the inclined surface 22 to provide proper orientation of the handle 36 on the front end 12 of the tray. However, the slot may be formed generally parallel to the bottom of the well portion 20 depending upon such factors as the length of the inclined portion 22 and the length of the frame and handle.

Figure 2:
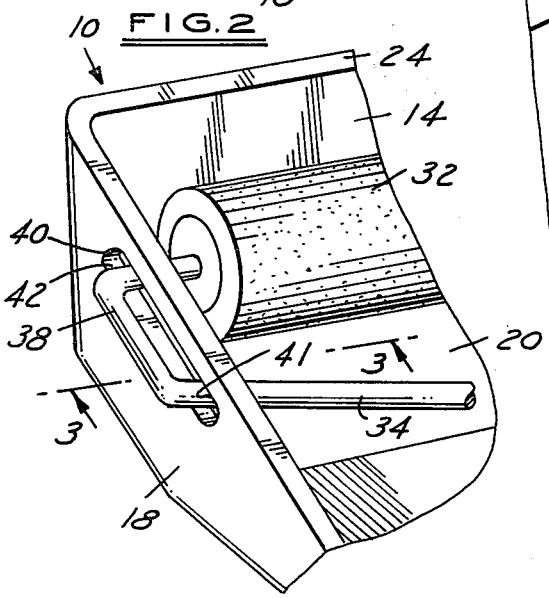
FIG. 2 is an enlarged fragmentary perspective illustration of the paint tray and roller of FIG. 1.
Figure 3:
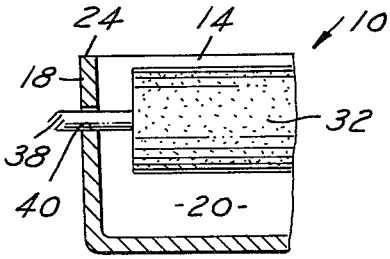
FIG. 3 is a partial sectional view of the invention of FIG. 2 as seen in the plane of arrows 3—3 of FIG. 2.

In this type of configuration, when the C-shaped frame portion 38 of the roller is inserted into the slot and extends outwardly of the tray, as illustrated generally in FIGS. 1, 2 and 3, a three point support is provided. This three point support includes a first support where the handle 36 rests on the front end of the tray, a second support as at 41 where a portion of the C-shaped frame closer to the handle is positioned in the slot and a third support point 42 where the C-shaped frame closer to the roller is positioned in the slot. This type of support permits the paint applying portion 32 to be suspended above and substantially parallel to the plane of the well 20.

The height of the slot 40, in a preferred embodiment, is sufficient to avoid a frictional fit with the C-shaped portion 38 of the frame. In the preferred embodiment, with the handle 36 resting on the front 12 of the tray, one point of support 41 provides contact between the top of the slot and the top of the frame while the other point of support 42 provides point contact at the bottom of the slot and the bottom of the frame. This is illustrated, in greater detail, in FIG. 3.

Figure 5:
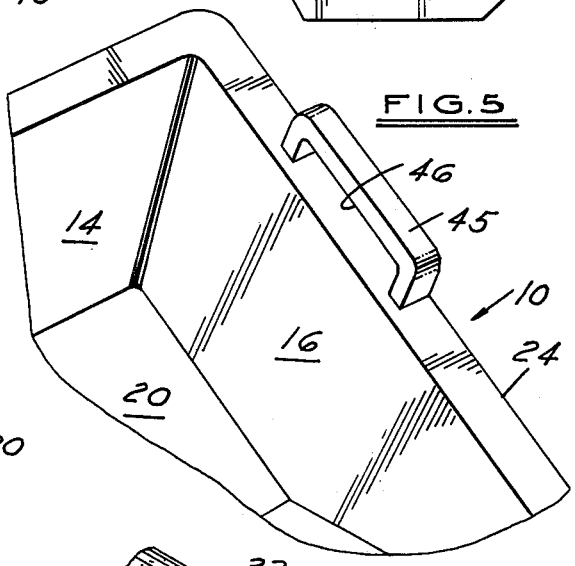
FIGS. 5–11 are fragmentary perspective illustrations of other embodiments of the present invention.

Referring next to FIG. 5, a second embodiment of the present invention is illustrated including a generally C-shaped support member 45 positioned above the flange 24. A slot 46 is defined between the underside of the support member 45 and the top of the flange 24 to receive the C-shaped portion 38 of the frame therein.

Figure 6:
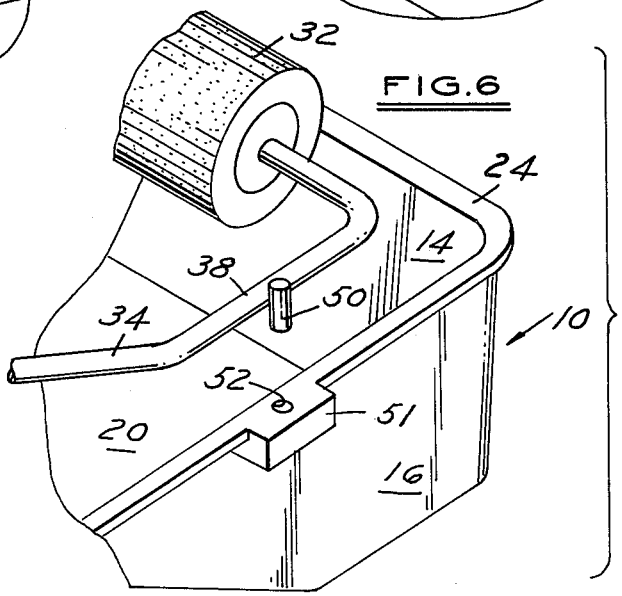

Another means for supporting the paint roller is illustrated in FIG. 6 where the frame includes a downwardly projecting post or stud 50. Extending laterally outwardly from the flange 24 is an auxiliary flange 51 having a suitable slot or aperture 52 of a size and shape configured to receive the post or stud 50. When the post is inserted in the slot 52, the paint applying portion of the roller is supported above the paint well.

Figure 7:
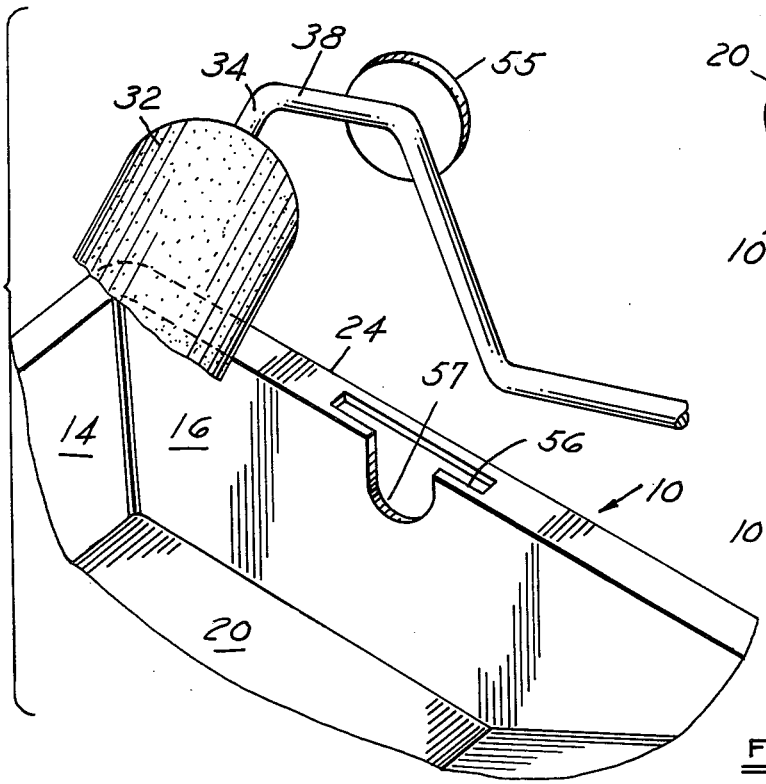
Figure 9:
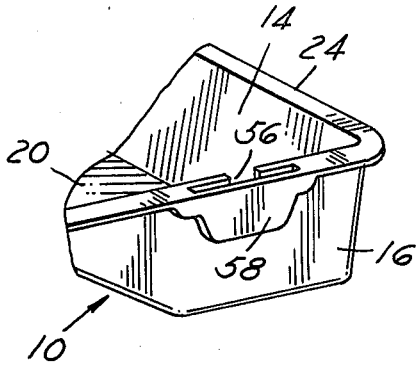

FIGS. 7 and 9 disclose a receptacle or slot for supporting a self-standing paint roller of the types shown in my prior U.S. Pat. No. 3,832,749. A self-standing paint roller of this type includes a button 55 positioned on the C-shaped portion of the frame 38. In the embodiment of FIGS. 7 and 9 the slot 56 is provided in the flange 24 of the paint tray and a portion of the tray is removed, as at 57, to accommodate the frame where the button is attached. This may be done during a molding step, if the tray is molded of plastic, or a knockout or any other conventional forming technique.

Alternatively, as in FIG. 9 the receptacle may be formed with a slot 56 and with an exterior wall 58 on the outside of the side wall 16 of the tray to prevent paint from spilling through the slot.

Figure 8:
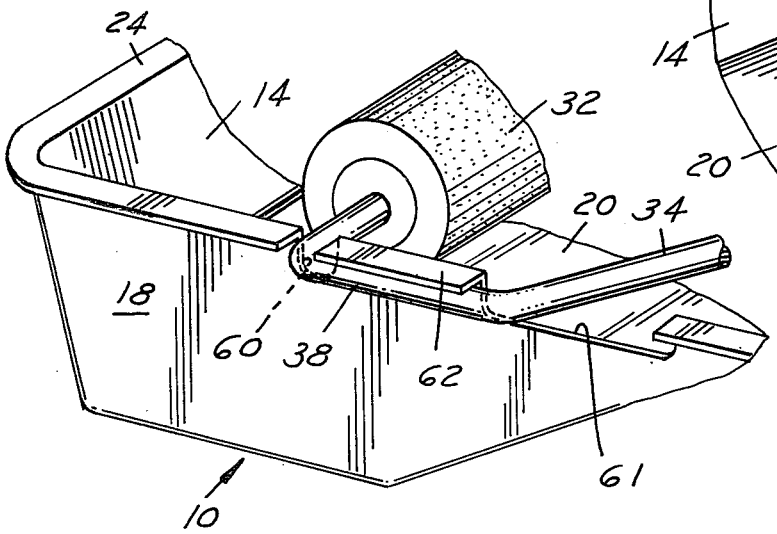

Yet another embodiment is illustrated generally in FIG. 8 wherein the flange and side wall of the tray are interrupted at two portions 60 and 61. The first interruption 60 is in the form of a notch in the tray flange and the side wall and the second interruption is an elongated portion as at 61. By providing an elongated slot 61, paint roller frames having different sized "C" shaped portions may be accommodated, and the C-shaped frame 38 may hook underneath the portion 62 of flange 24 remaining between the two removed portions 60, 61 of the tray.

Figure 10:
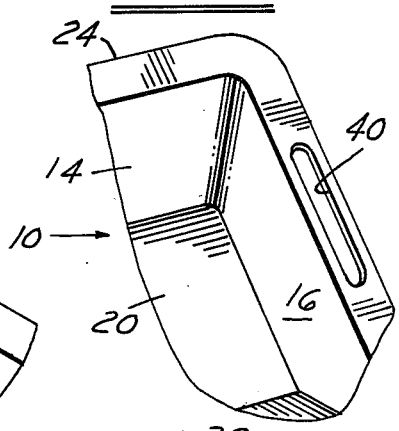

The embodiment of FIG. 10 provides a slot 40 extending through the flange 24 to receive the C-shaped portion 38 of the paint roller frame 34.

Figure 11:
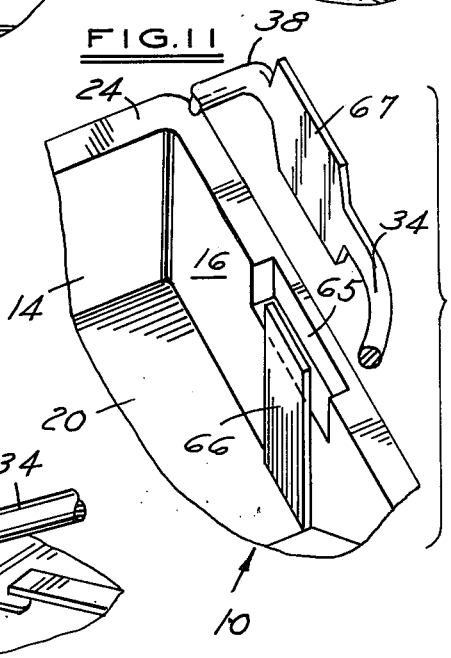

Finally, the embodiment of FIG. 11 has a receptacle 65 cut out of the juncture of the side wall 16 and the flange 24. An upstanding rib 66 extends parallel to wall 16, interiorly of the tray, to form a retainer. This embodiment is particularly suited to receive and support a paint roller having a flat 67 formed on the C-shaped portion 38 of the frame with the flat fitting in the receptacle or notch 65. Rib 66 prevents the frame 34, and hence the roller, from sliding laterally into the paint well.

The foregoing is a complete description of operative embodiments of the present invention and should not be read in a limiting sence but only as describing the underlying inventive concepts. The invention may be further developed within the scope of the following claims.

What is claimed is:

1. In a paint tray for use with a paint roller or the like, said paint roller having a bent wire frame supporting a paint applying portion at one end and having a handle at the other end, said paint tray including front and rear ends, opposed side walls, a paint well adjacent to said rear end for storing a supply of paint, and an integral inclined surface tapering upwardly from said paint well to said front end for rolling excess paint off said paint applying portion whereby excess paint flows into said well, the improvement comprising:

a receptacle in said paint tray for receiving and retaining said bent wire frame for supporting the paint applying roller above the paint well;

said receptacle including a slot, said slot being elongated in a direction from said paint tray front end to said paint tray rear end for receiving the bent part of said bent wire frame, said slot being at an angle generally parallel to said inclined surface to provide proper orientation of said handle on said front end of said tray;

said receptacle slot extending through the side wall of said tray;

a three-point support including said handle resting on said front of said tray to provide a first point of support, said bent part of said bent wire frame and the edge of said receptacle being in contact in two places to provide second and third support points in supporting the paint applying roller above the paint well and to permit said paint applying portion to be suspended above and substantially parallel to the plane of said well, said second support point being between the top surface of said slot and a top portion of said bent part of said bent wire frame and said third support point being between the bottom surface of said slot and a bottom portion of said bent part.

* * * * *